US009937553B2

(12) United States Patent
Adams

(10) Patent No.: US 9,937,553 B2
(45) Date of Patent: Apr. 10, 2018

(54) LIQUID COOLED DIE CASTING MOLD WITH HEAT SINKS

(71) Applicant: Kenneth Ray Adams, Troy, MI (US)

(72) Inventor: Kenneth Ray Adams, Troy, MI (US)

(73) Assignee: Magna International Inc., Aurora, Ontario (CA)

( * ) Notice: Subject to any disclaimer, the term of this patent is extended or adjusted under 35 U.S.C. 154(b) by 0 days.

(21) Appl. No.: 15/699,264

(22) Filed: Sep. 8, 2017

(65) Prior Publication Data

US 2017/0368600 A1 Dec. 28, 2017

Related U.S. Application Data

(63) Continuation of application No. 14/783,972, filed as application No. PCT/US2014/034124 on Apr. 15, 2014, now Pat. No. 9,782,825.

(60) Provisional application No. 61/811,912, filed on Apr. 15, 2013.

(51) Int. Cl.

| | |
|---|---|
| ***B22D 17/22*** | (2006.01) |
| ***B22D 18/04*** | (2006.01) |
| ***B22D 15/00*** | (2006.01) |
| ***B22D 30/00*** | (2006.01) |

(52) U.S. Cl.

CPC ..... *B22D 18/04* (2013.01); *B22D 15/00* (2013.01); *B22D 17/22* (2013.01); *B22D 30/00* (2013.01)

(58) Field of Classification Search

CPC .... B22D 15/00; B22D 17/22; B22D 17/2218; B22D 18/04; B29C 45/73

See application file for complete search history.

(56) References Cited

U.S. PATENT DOCUMENTS

| | | | | |
|---|---|---|---|---|
| 2,268,981 | A * | 1/1942 | Ericson | B22C 9/06 164/347 |
| 4,875,518 | A * | 10/1989 | Imura | B22C 9/061 164/119 |
| 5,443,111 | A * | 8/1995 | Colvin | B22C 9/061 164/254 |
| 2006/0249872 | A1* | 11/2006 | Manuel | B22D 17/2218 264/225 |
| 2013/0295219 | A1* | 11/2013 | Neufarth | B29C 33/046 425/552 |

* cited by examiner

*Primary Examiner* — Kevin E Yoon
(74) *Attorney, Agent, or Firm* — Dickinson Wright PLLC

(57) ABSTRACT

A low pressure aluminum casting apparatus includes a pair of steel dies each presenting a molding surface and a heat transfer surface. Copper heat sink blocks are disposed on the heat transfer surfaces to remove heat from the steel dies. Steel contact plates and steel spacer plates can be disposed between the heat sink blocks and the steel dies to optimize cooling. In addition, a portion of each contact plate can be spaced from the steel die to reduce cooling. The steel dies include conventional cooling passages for conveying cooling fluid, and the heat sink blocks, contact plates, and spacer plates also include cooling channels for conveying cooling fluid.

3 Claims, 10 Drawing Sheets

LIQUID COOLED DIE CASTING MOLD WITH HEAT SINKS

CROSS-REFERENCE TO PRIOR APPLICATIONS

This U.S. Continuation patent application claims the benefit of U.S. National Stage patent application Ser. No. 14/783,972 filed Oct. 12, 2015 entitled "Liquid Cooled Die Casting Mold With Heat Sinks," which claims the benefit of PCT International Patent Application Serial No. PCT/US2014/034124 filed Apr. 15, 2014 entitled "Liquid Cooled Die Casting Mold With Heat Sinks," which claims the benefit of U.S. Provisional Patent Application Ser. No. 61/811,912 filed Apr. 15, 2013, entitled "Liquid Cooled Die Casting Mold With Heat Sinks," the entire disclosures of the applications being considered part of the disclosure of this application and hereby incorporated by reference.

BACKGROUND OF THE INVENTION

1. Field of the Invention

The invention provides a casting apparatus, a method for forming the casting apparatus, and a method for casting metal.

2. Related Art

Low pressure aluminum casting molds are typically provided by a pair of steel dies. The steel dies are mounted in a press above a sealed holding furnace containing the molten aluminum. The mold is typically connected to the holding furnace by riser tubes, which are also referred to as feed tubes or up tubes. Low pressure air is introduced into the holding furnace, and the pressure pushes the molten aluminum up the riser tubes and into the mold. The inside of the mold also has a low pressure, which sucks the molten aluminum up the riser tubes and onto the mold. Thus, the molten aluminum fills the mold from the bottom, and the combination of the pressure from the holding furnace and the pressure inside the mold can provide optimum mold filling. Another relatively low pressure, typically about 50 tons, is applied to the dies to keep the mold closed while molten aluminum fills the mold. The pressure is maintained for a predetermined amount of time as the aluminum solidifies in the mold to reduce porosity, shrink, and "no-fill" defects.

Cooling pipes can be used to convey water or compressed air and remove heat from the steel dies, which accelerates the shot-to-shot cycle time. Certain areas of the dies, such as the thickest areas, typically require more aggressive cooling to avoid shrink and/or porosity. Thermally isolated inserts can be drilled into the thickest sections of each die, and water can be pumped through the inserts to cool the thickest sections without cooling the bulk of each die. Ideally, the cooling time is set so that the aluminum solidifies quickly to avoid shrink porosity, but fills the mold without "no-fill" defects. However, the rate at which the dies are cooled by the cooling fluid is difficult to control, and sometimes the dies are overcooled, which leads to the "no-fill" defects and thus un-useable scrap.

In other cases, liquid cooling does not remove enough heat, so a blower fan is positioned at the back of the mold. However, fan cooling is very sensitive to ambient conditions and it is not spatially controllable. Therefore, fan cooling is not effective when only certain areas of the dies require additional cooling. A predictable and repeatable method for removing heat from concentrated areas of casting dies is still needed.

SUMMARY OF THE INVENTION

The invention provides an apparatus for casting metal in a predictable and repeatable manner, with a reduced shot-to-shot cycle time. The apparatus includes a die formed of a first metal material. The die includes a molding surface for casting the metal to a desired shape. A heat sink block is disposed on the die and is spaced from the molding surface. The heat sink block is formed of a second metal material having a thermal conductivity greater than the thermal conductivity of the first metal material.

The invention also provides a method for manufacturing an apparatus for casting metal. The method includes providing a die formed of a first metal material and presenting a molding surface. The method next includes disposing a heat sink block formed of a second metal material having a thermal conductivity greater than the thermal conductivity of the first metal material on the die and spaced from the molding surface.

A method for casting metal using the casting apparatus is also provided. The method includes providing a shot of molten metal to the mold; and removing the solidified metal from the mold prior to providing another shot of molten metal to the mold. The method also includes conveying a cooling fluid through the cooling channels of the heat sink blocks for a predetermined amount of time to achieve a desired shot-to-shot cycle time.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION

Figure 1:
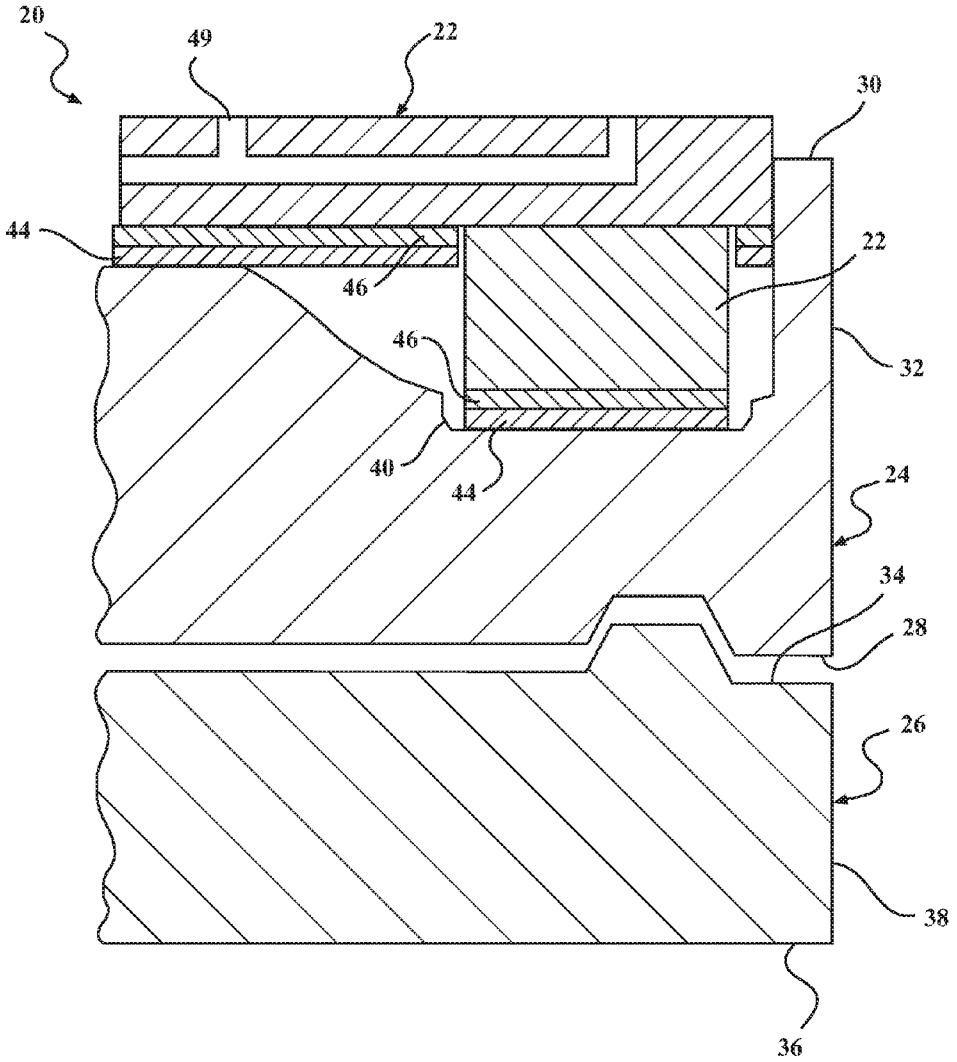
FIG. 1 is a cross-sectional view of a casting apparatus according to an exemplary embodiment.

An apparatus 20 for casting metal, such as aluminum, according to one exemplary embodiment is generally shown in FIG. 1. The apparatus 20 includes heat sink blocks 22 for removing heat from a pair of dies 24, 26 in a predictable and repeatable manner. The apparatus 20 is also capable of providing a reduced shot-to-shot cycle time, less shrink porosity, and fewer "no-fill" defects than conventional casting apparatuses, which do not include the heat sink blocks.

As shown in FIG. 1, the apparatus 20 includes an upper die 24 and a lower die 26 each formed of a first metal material. In one exemplary embodiment, the first metal material is a steel material, for example any grade of steel or steel alloy. However, the first metal material can vary depending on the composition and geometry of the parts to be formed, and the temperatures required during the casting process. The upper die 24 includes an upper molding surface 28 and an oppositely facing upper heat transfer surface 30. An upper side surface 32 spaces the upper molding surface 28 from the upper heat transfer surface 30. The upper molding surface 28 presents a contour for forming the molten metal into a desired geometric shape. The contour shown in FIG. 1 is fairly simple, but the contour can vary depending on the metal part to be formed.

The lower die 26 includes a lower molding surface 34 facing the upper molding surface 28 to present a mold therebetween. During the casting process, molten metal fills the mold and conforms to the contour of the molding surfaces 28, 34 to form the metal part. The lower die 26 also includes a lower heat transfer surface 36 and a lower side surface 38 spacing the lower molding surface 34 from the lower heat transfer surface 36.

The apparatus 20 also includes at least one of the heat sink blocks 22 disposed on at least one of the dies 24, 26 in a location spaced from the molding surfaces 28, 34. The heat sink blocks 22 are formed of a second metal material having a thermal conductivity greater than the thermal conductivity of the first metal material of the dies 24, 26. Preferably, the second metal material used to form the heat sink blocks 22 is a copper material, which can be pure copper or any type of copper alloy. Alternatively, the heat sink blocks 22 can be formed of another second metal material also having a thermal conductivity greater than the thermal conductivity of the first metal material of the dies 24, 26. In FIG. 1, the heat sink blocks 22 are disposed on the upper die 24, but not the lower die 26. However, the heat sink blocks 22 are typically disposed on both dies 24, 26. FIG. 1 also shows the heat sink blocks 22 disposed along the upper heat transfer surface 30, but the heat sink blocks 22 could alternatively be disposed on another surface of the die 24, such as the side surface 32, as long as the heat sink blocks 22 are spaced from the molding surface 28. The number, size, and location of heat sink blocks 22 varies depending on the geometric shape and size of the metal part to be formed, and the amount of cooling necessary to achieve the desired cycle time and fill the mold without shrink porosity and without "no-fill" defects.

Figure 2:
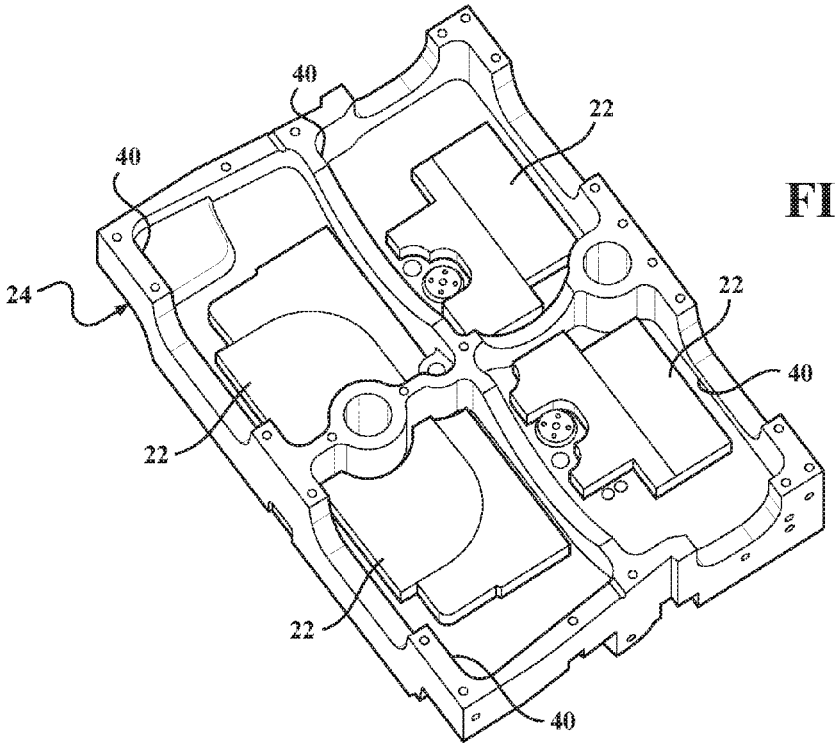
FIG. 2 is a perspective top view of an upper die according to another exemplary embodiment.
Figure 3:
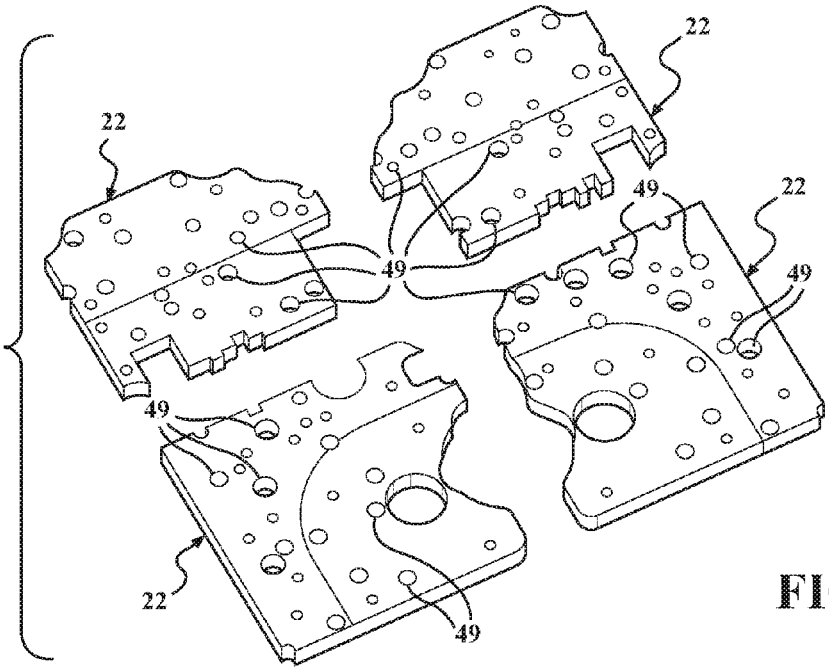
FIG. 3 illustrates heat sink blocks according to an exemplary embodiment.

Each heat transfer surface 30, 36 typically includes a plurality of recessed areas 40 for containing the heat sink blocks 22. FIG. 1 shows one recessed area 40 in the upper die 24, but typically each die 24, 26 includes a plurality of the recessed areas 40. FIG. 2 is a perspective top view of the upper die 24 according to another exemplary embodiment including four recessed areas 40 each containing one of the heat sink blocks 22. FIG. 3 is a perspective view of four heat sink blocks 22 having another exemplary design. The heat sink blocks 22 disposed on the upper die 24 can have a design different from the heat sink blocks 22 on the lower die 26. The total number of heat sink blocks 22, and the dimensions and design of each heat sink block 22 can also vary depending on the amount of cooling desired.

Figure 4:
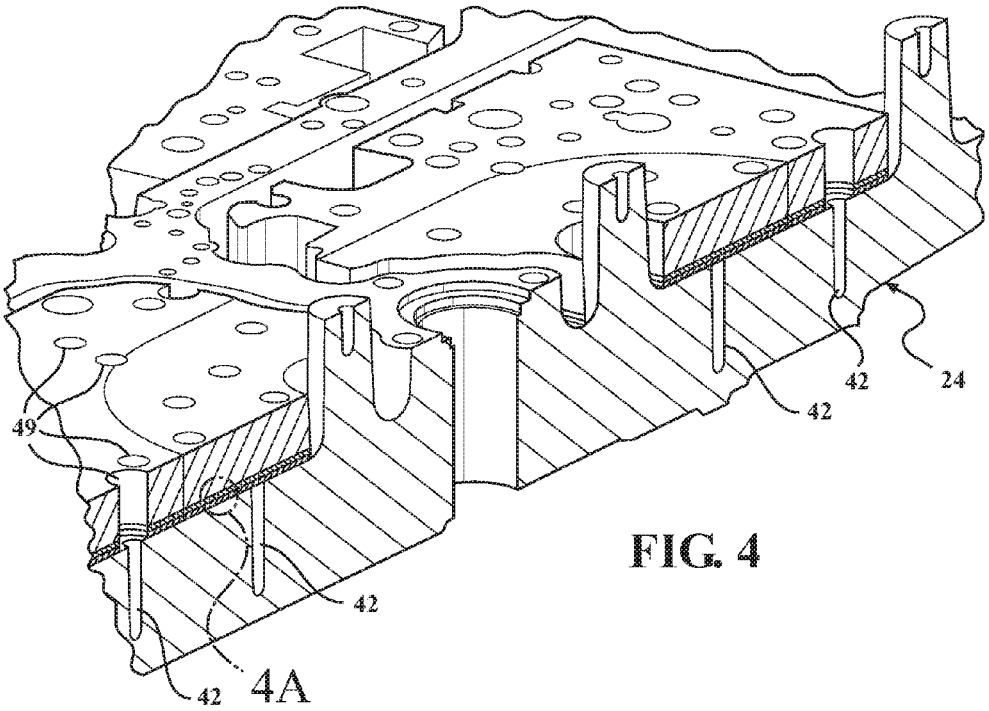
FIG. 4 is a cross-sectional view of the upper die showing the heat sink blocks, contact plates, and spacer plates according to an exemplary embodiment.

Each die 24, 26 also typically includes a plurality of conventional cooling passages 42 for conveying a cooling fluid, such as water or compressed air, to remove heat from the dies 24, 26 during the casting process. FIG. 4 is a cross-sectional view of the upper die 24 according to an exemplary embodiment with a plurality of the conventional cooling passages 42.

Figure 4A:
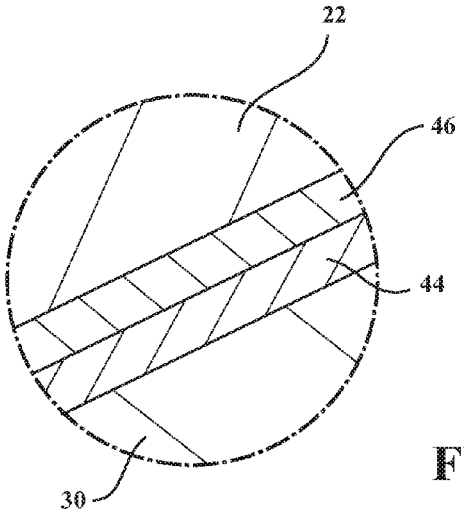
FIG. 4A is an enlarged view of a portion of FIG. 5.
Figure 5:
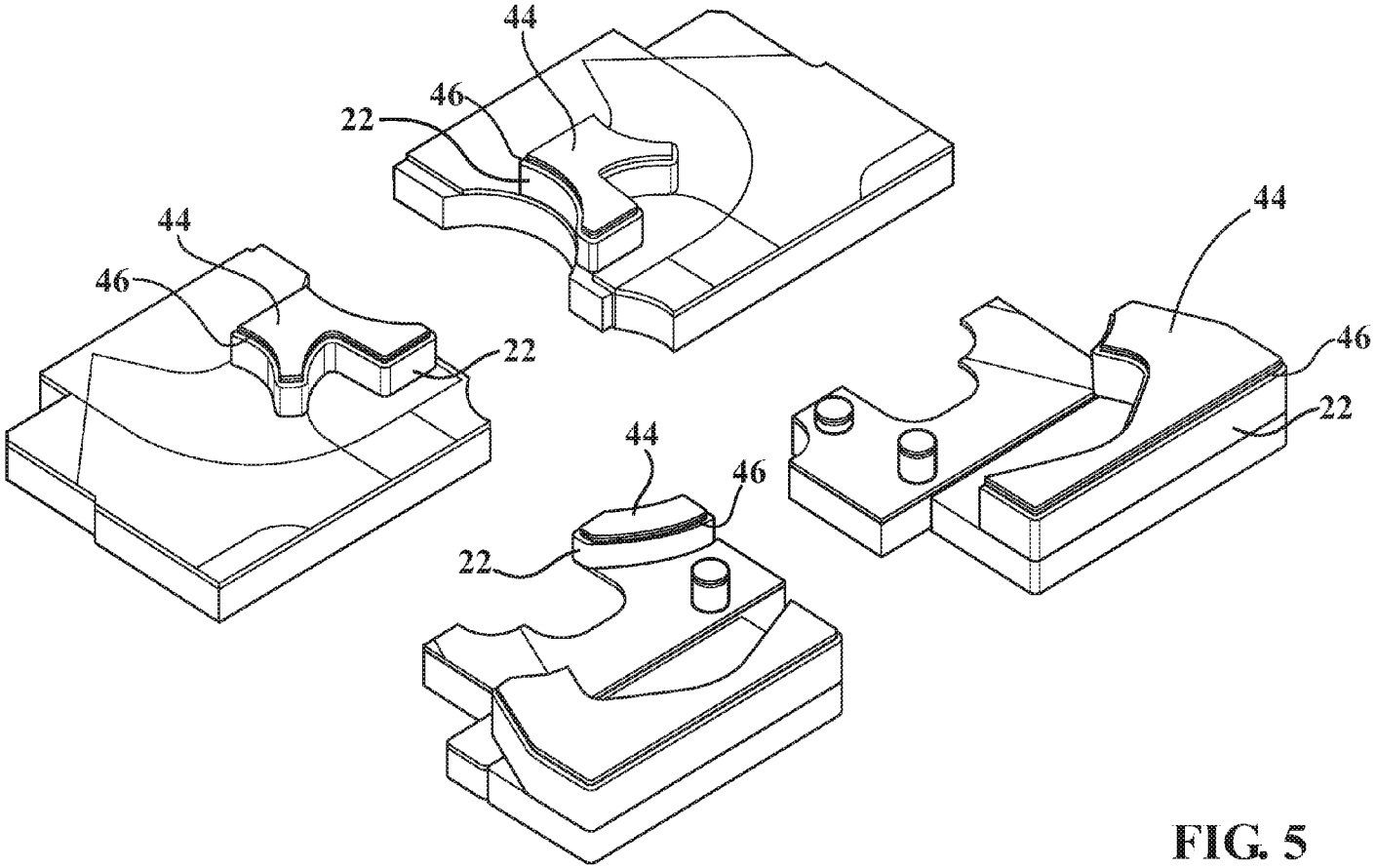
FIG. 5 is a perspective view of the heat sink blocks, spacer plates, and contact plates stacked together according to an exemplary embodiment prior to being bolted to a die.

The casting apparatus 20 can also include a contact plate 44 disposed between each heat sink block 22 and the adjacent die 24, 26, and a spacer plate 46 disposed between each contact plate 44 and heat sink block 22, as shown in FIGS. 1, 4, and 5, to reduce the amount of heat transferred from the die 24, 26 to the heat sink block 22. FIG. 4A is an enlarged view of a portion of FIG. 4 showing the heat sink block 22 spaced from the heat transfer surface 30 by one of the contact plates 44 and one of the spacer plates 46. FIG. 5 is a perspective view of four sets contact plates 44 and four spacer plates 46 stacked on a heat sink block 22 according to another exemplary embodiment prior to bolting to one of the dies 24, 26.

The contact plates 44 and spacer plates 46 are formed of a third metal material, typically a steel material like the dies 24, 26, but can be formed of another metal material. The total number and dimensions of the contact plates 44 and spacer plates 46 vary depending on the amount of cooling desired. However, in the embodiment of FIG. 1, the contact plates 44 and spacer plates 46 each have a thickness of ⅛ inch. Typically, one of the spacer plates 46 is sandwiched between a heat sink block 22 and contact plate 44. Alternatively, multiple spacer plates 46 can be sandwiched between a heat sink block 22 and contact plate 44, or the contact plate 44 can be disposed along the heat sink block 22 without a spacer plate 46. In other words, the casting apparatus can include no spacer plates 46. In another embodiment, the casting apparatus 20 can include one or more of the spacer plates 46 without a contact plate 44. The casting apparatus 20 can also be formed with at least one heat sink block 22 but without any contact plates 44 or spacer plates 46.

The contact plates 44 can be disposed along all of the heat sink blocks 22, or along only some of the heat sink blocks 22 where less cooling is desired. In addition, the contact plate 44 can be disposed along the entire bottom surface of the heat sink block 22, or along only a portion of the heat sink block 22. In one embodiment, the contact plate 44 is provided as a steel shim disposed in the recessed area 40 of the die 24, 26.

Figure 6:
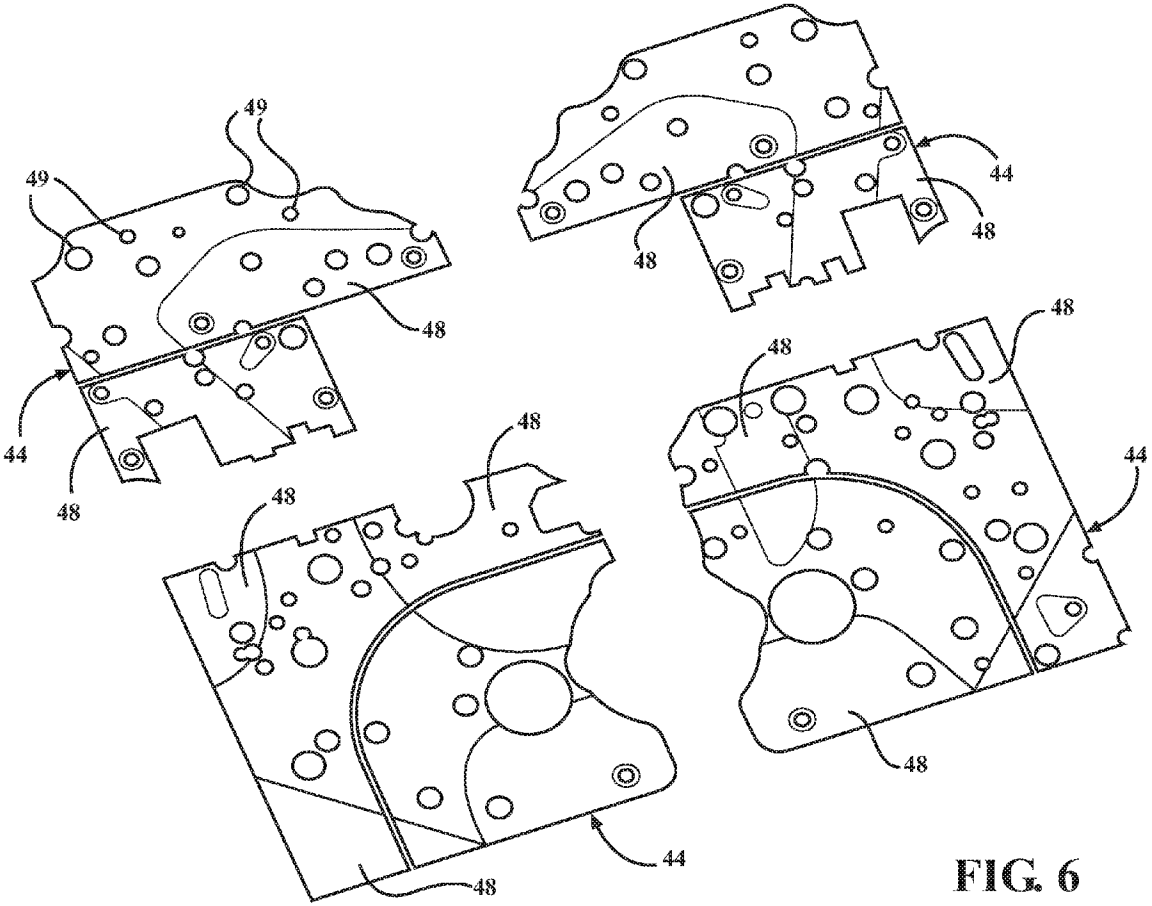
FIG. 6 illustrates contact plates according to an exemplary embodiment.

To further reduce the amount of cooling along certain areas of the dies 24, 26, the contact plate can be stepped, in which case a portion of each contact plate 44 is spaced from the adjacent heat transfer surface 30, 36 of the die 24, 26 by an air gap, while the remaining portions of the contact plate 44 engage the heat transfer surface 30, 36 of the die 24, 26. Less heat is removed from the die 24, 26 along the air gap than along the area of the contact plate 44 engaging the die 24, 26. In one embodiment, 25% of the total area of each the contact plate 44 is spaced from the adjacent heat transfer surface 30, 36, and the distance between the contact plate 44 and the adjacent heat transfer surface 30, 36, or the length of the air gap, is 0.040 inches. The air gap is typically provided by reducing the thickness along a portion of the contact plate 44, for example by machining, so that the contact plate 44 includes an area with reduced thickness, which is referred to as a relief area 48. The relief area 48 is spaced from the die 24, 26 to provide the air gap, while the remaining thicker portions of the contact plate 44 engage the die 24, 26. Thus, the contact plates 44 can provide more or less cooling at specific points or in specific areas. FIG. 6 illustrates four exemplary stepped contact plates 44 with the relief areas 48.

Figure 7:
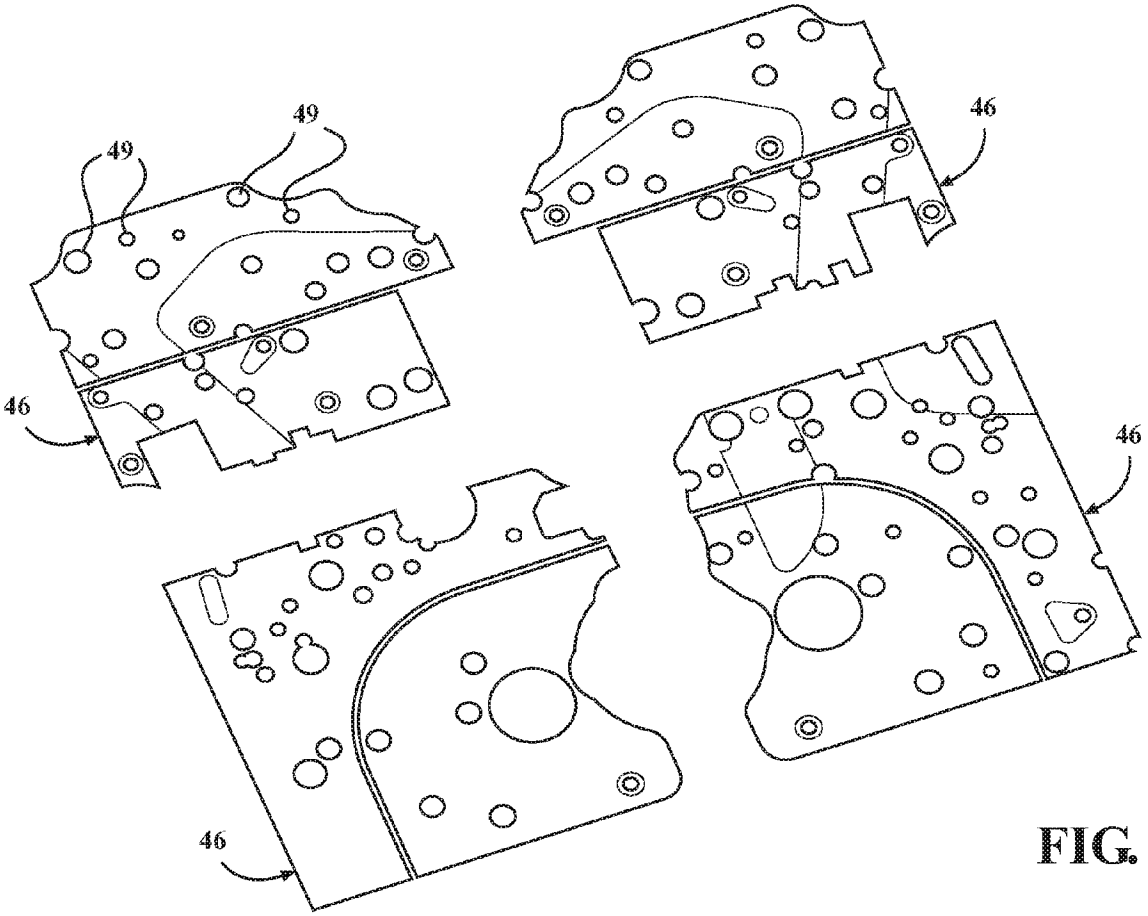
FIG. 7 illustrates spacer plates according to an exemplary embodiment.

Like the contact plates 44, the spacer plates 46 can also be stepped with relief areas 49 matching the relief areas 48 of the adjacent contact plates 44, or having relief areas 49 different from those of the adjacent contact plate 44. FIG. 7 illustrates four exemplary stepped spacer plates 46 with the relief areas 49. However, the spacer plates 46 are typically flat.

Figure 8:
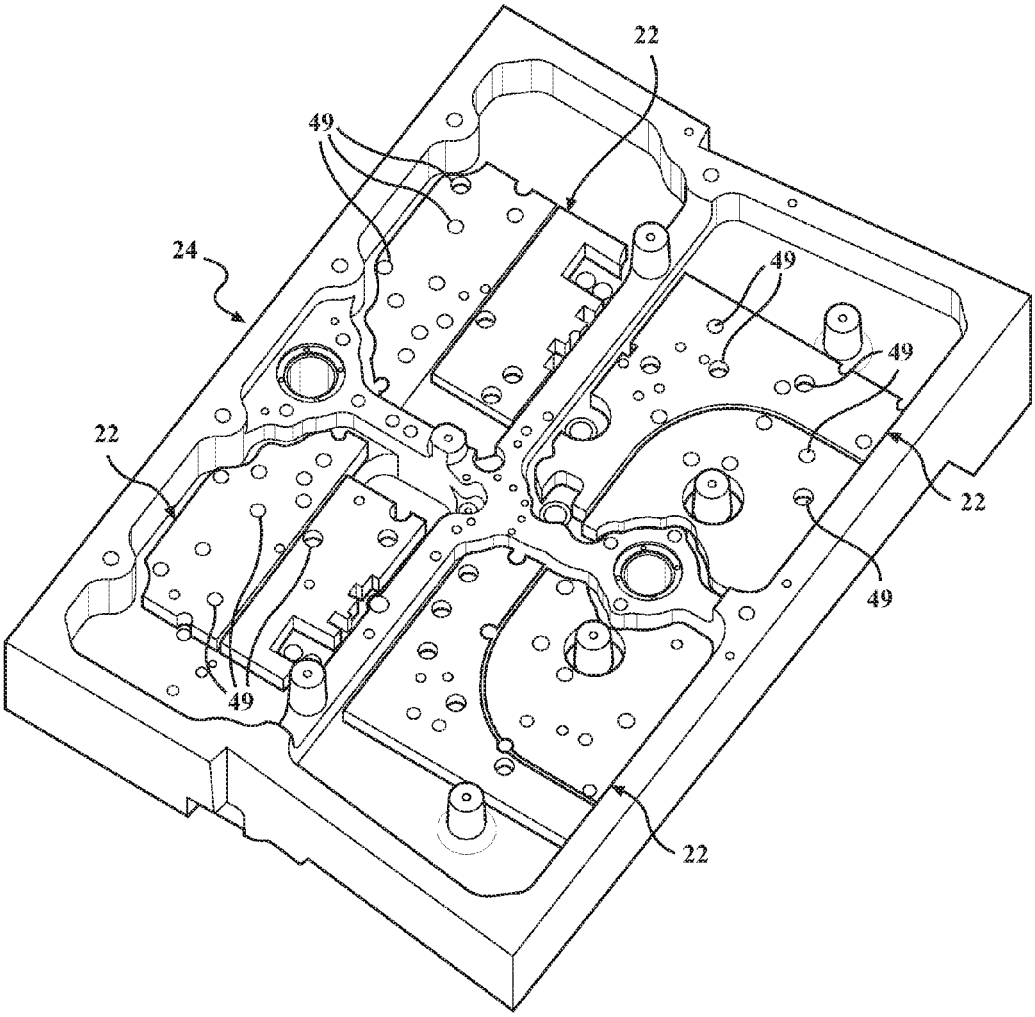
FIG. 8 is a perspective view of an upper die showing cooling channels according to an exemplary embodiment.

Each heat sink block 22 preferably includes a plurality of cooling channels 49 for conveying cooling liquid, as shown in FIGS. 1, 3, and 4. The cooling channels 49 also typically extend through the contact plates 44 and the spacer plates 46. The cooling channels 49 can extend longitudinally through the heat sink block 22 and traverse to the heat transfer surface 30, 36 of the die 24, 26. As shown in FIG. 4, at least one of the cooling channels 49 is aligned with one of the conventional cooling passages 42 of the die 24, 26, and preferably a plurality of the cooling channels 49 and conventional cooling passages 42 are aligned with one another. The cooling channels 49 can also extend through the top surface of the heat sink block 22 and run generally parallel to the heat transfer surface 30, 36 of the die 24, 26, as shown in FIG. 1. The number and design of the cooling channels 49 varies depending on the amount of cooling desired. Typically each heat sink block 22 includes at least one cooling channel 49, but could include no cooling channels 49. FIG. 8 is a perspective view of the upper die 24 showing a plurality of the cooling channels 49.

Figure 9:
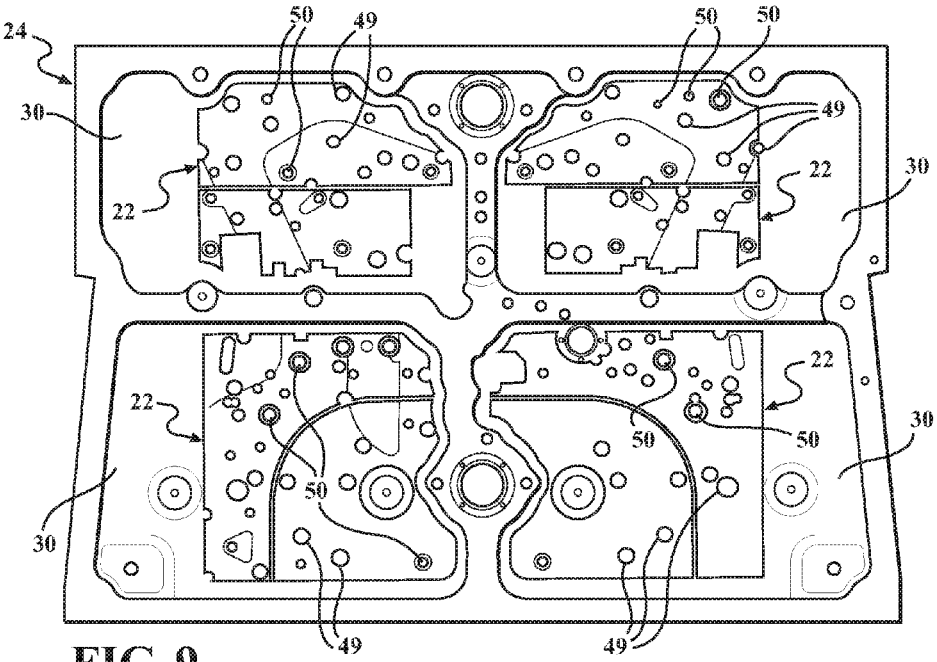
FIG. 9 is a top view of the heat sink blocks bolted to the upper die of FIG. 8.
Figure 10:
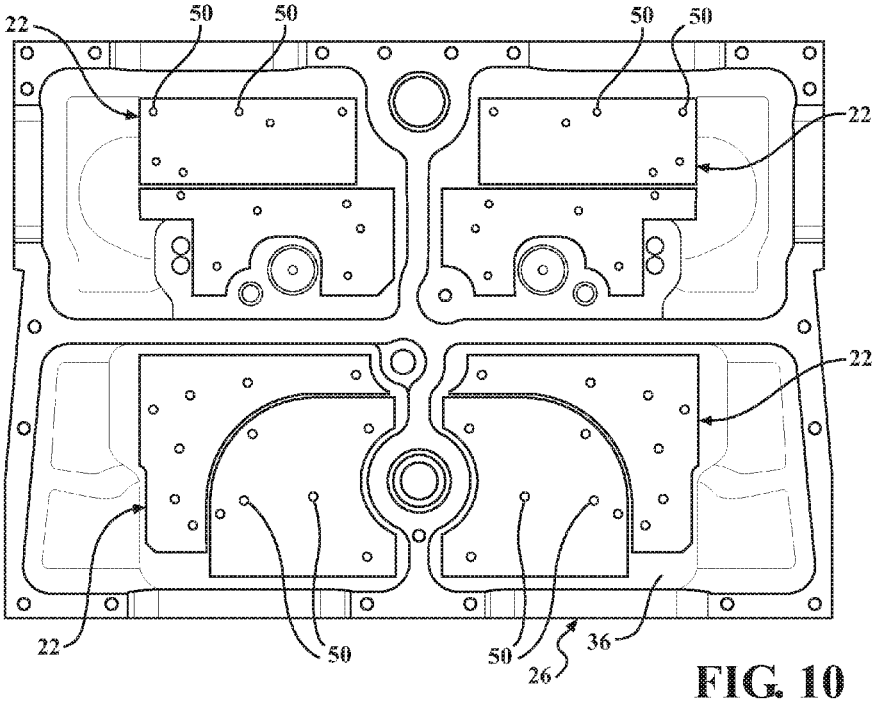
FIG. 10 is a top view of the heat sink blocks bolted to a lower die used in an assembly with the upper die of FIG. 9.

The casting apparatus 20 also includes a plurality of bolts 50 for securing the heat sink blocks 22 to the dies 24, 26, although other attachment methods could be used. The bolts 50 extend longitudinally through the heat sink blocks 22, spacer plates 46, and contact plates 44. FIG. 9 shows the heat sink blocks 22 bolted to the upper heat transfer surface 30, and FIG. 10 shows the heat sink blocks 22 bolted to the lower heat transfer surface 36.

Figure 11:
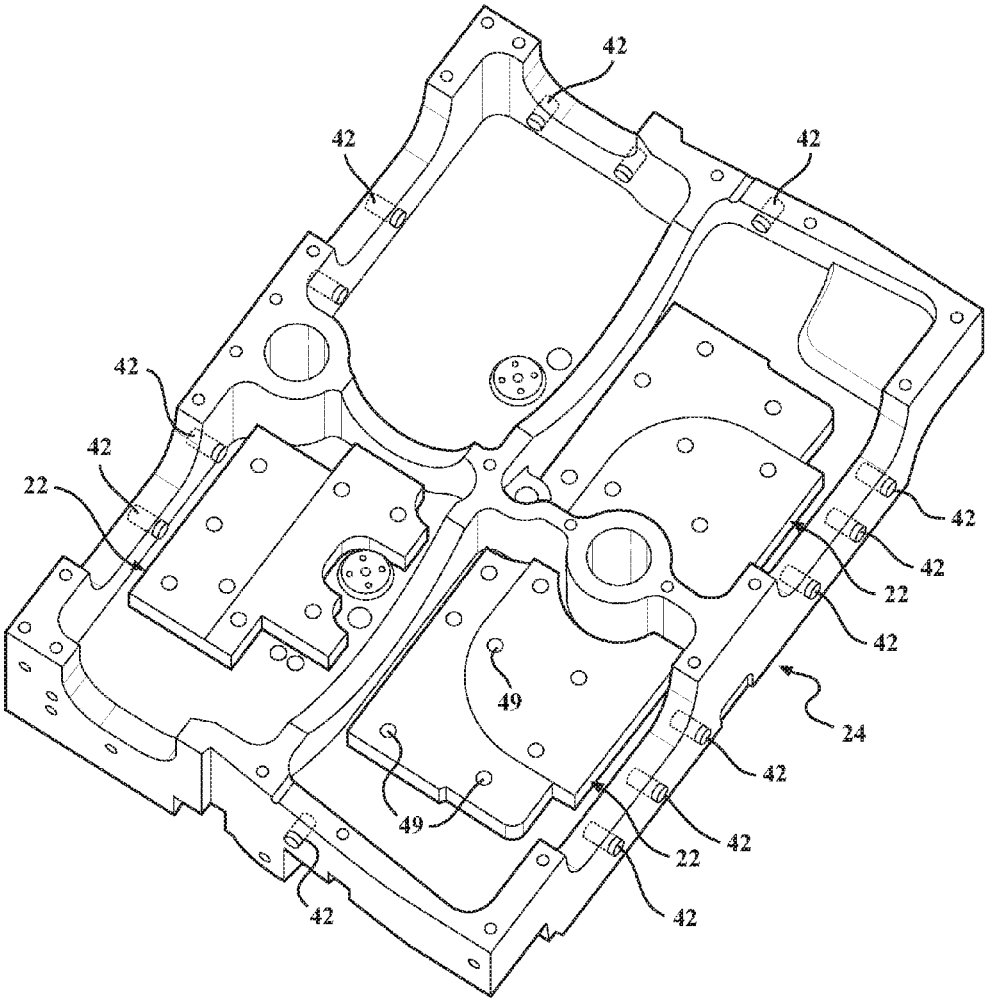
FIG. 11 shows the upper die and the heat sink blocks with the conventional cooling passages according to an exemplary embodiment.
Figure 12:
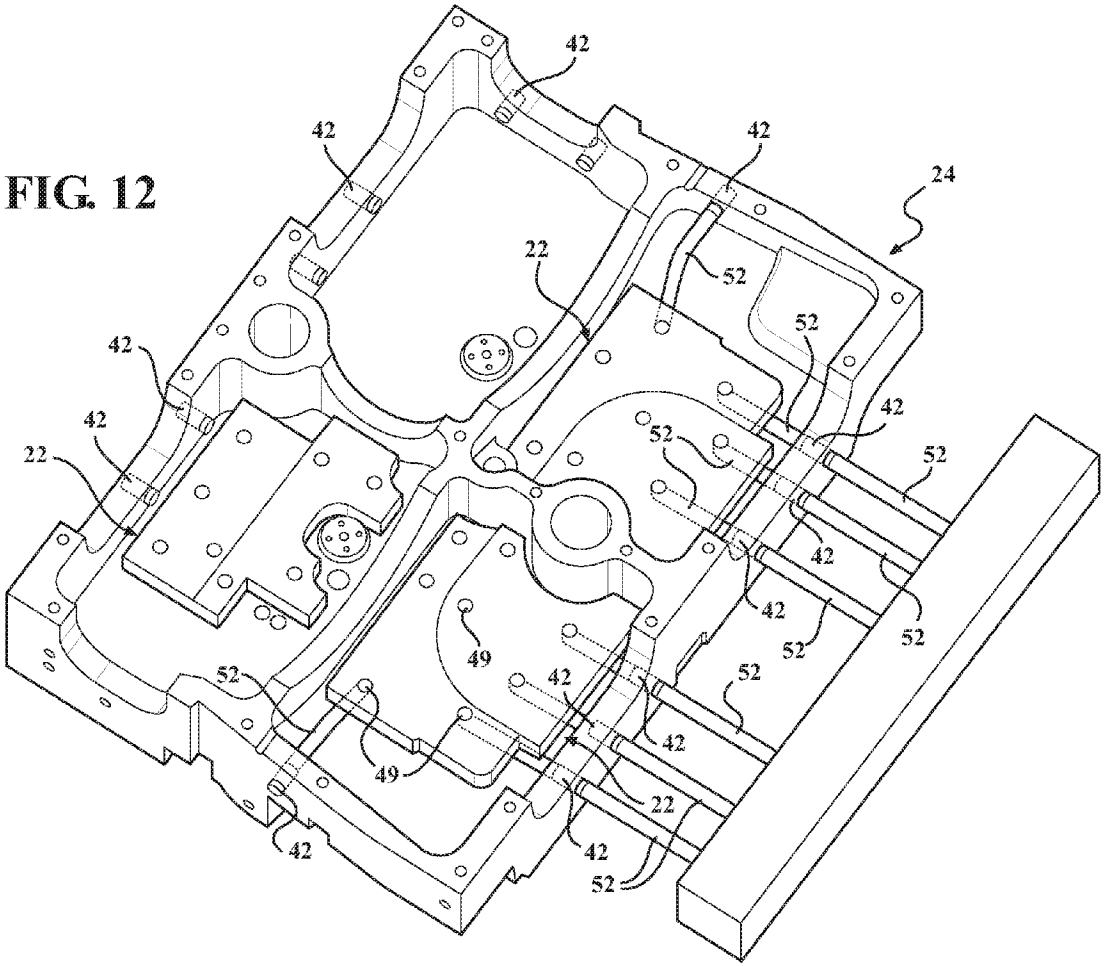
FIG. 12 shows the upper die of FIG. 11 with fluid lines connecting the conventional cooling passages to the heat sink blocks.

The heat sink blocks 22 are oftentimes used with the die 24, 26 having conventional cooling channels 42, as shown in FIG. 11. A plurality of fluid lines 52 are then installed and extend from a cooling fluid supply or source (not shown) to the cooling channels 49 of the heat sink blocks 22, or through the cooling channels 49 in the heat sink blocks 22, as shown in FIG. 12. The fluid lines 52 can also extend through the spacer plates 46 and contact plates 44.

The invention also provides a method for forming the casting apparatus 20. The method includes disposing at least one of the heat sink blocks 22 on the heat transfer surface 30, 36 of one of the dies 24, 26, and connecting the cooling channels 49 of the heat sink blocks 22 to the cooling fluid supply by the fluid lines 52.

The casting apparatus 20 is typically formed by retrofitting a conventional casting apparatus. This includes connecting the conventional cooling passages 42 to the cooling channels 49 using the fluid lines 52. In the embodiment of FIG. 12, eight fluid lines 52 are maintained in a block on each side of the dies 24, 26. Four of the fluid lines 52 are inlet lines for conveying the cooling fluid to the cooling channels 49 of the heat sink blocks 22, and four of the fluid lines 49 are outlet lines for conveying the used cooling fluid away from the dies 24, 26. The blocks maintaining the fluid lines 52 are typically bolted to the casting apparatus 20, and a connector, such as a Stäubli connector, connects the fluid lines 52 to the blocks.

If the casting apparatus 20 is manufactured by retrofitting a conventional casting apparatus, and the conventional casting apparatus has more fluid lines than needed, then some of the conventional fluid lines may be removed. For example, one or more fluid lines for conveying compressed air can be removed, and one or more fluid lines for conveying water can be removed.

The invention also provides a method for casting metal, such as aluminum, with a reduced shot-to-shot cycle time. The shot-to-shot cycle time is the time it takes to fill the mold and form a solid metal part. This method includes filling the mold with the molten metal, and supplying cooling fluid to the cooling channels 49 of the heat sink blocks 22 and the cooling passages 42 of the dies 24, 26 for a predetermined amount of time, referred to as the cooling time, while the molten metal fills the mold or while the molten metal is disposed in the mold. The cooling time is optimized to achieve a desired shot-to-shot cycle time, without shrink porosity and without "no-fill" defects. In one embodiment, the preferred cycle time is about 209 seconds or less.

The method typically includes mounting the dies 24, 26 in a press above a sealed holding furnace containing the molten metal, and connecting the lower die 26 to the holding furnace by riser tubes (not shown). The method next includes introducing low pressure air into the holding furnace, which pushes the molten metal up the riser tubes and into the mold, such that the molten metal fills the mold from the bottom. A relatively low pressure is also applied to the dies 24, 26 to keep the mold closed while the molten metal fills the mold. The pressure is maintained for a predetermined amount of time as the metal solidifies in the mold to reduce porosity, shrink, and "no-fill" defects. Once the metal solidifies and forms the metal part, the metal part is removed from the mold and the next shot is immediately provided to the mold.

The optimized cooling time can be determined by first obtaining the minimum die temperature required to fill the mold without "no-fill" defects. In other words, the average die temperature must be equal to or greater than the minimum die temperature, otherwise "no-fill" defects could occur. The minimum die temperature can be determined by simulating a conventionally cooled casting process, without the heat sink blocks, at a longer cycle time, which is correlated with the actual process.

Once the minimum die temperature is determined, the method includes obtaining a temperature simulation showing the average die temperature when the casting apparatus 20 of the present invention is used. The cycle time used to obtain this temperature simulation is the same as the cycle time used to find the minimum die temperature. The temperature simulations show the areas of the dies 24 that require more cooling and areas that require less cooling.

In view of the minimum die temperature and temperature simulations of the inventive casting apparatus 20, the method includes estimating the cooling time for each of the cooling channels 49 to achieve the desired shot-to-shot cycle time and fill the mold without shrink porosity and without "no-fill" defects. The estimated cooling time for each cooling channel 49 should be made in view of the dimensions and location of the heat sink blocks 22.

Next, another temperature simulation is obtained based on the estimated cooling times and the desired cycle time. This temperature simulation provides feedback on how the cooling times can be adjusted for each cooling channel 49 to achieve the desired cycle time. The cooling times depend on the design of the dies 24, 26 and heat sink block 22. For example, the cooling time for certain cooling channels 49 can be longer than the cooling time for other cooling channels 49. The method steps can be repeated until the desired shot-to-shot cycle time, for example 209 seconds or less, is achieved and the temperate simulation indicates the average die temperature is greater than or equal to the minimum die temperature required to avoid "no-fill" defects. Temperature simulations indicate the temperature of the die 24 with the heat sink blocks 22 is lower than the temperature of a conventional die without the heat sink blocks 22 under the same process conditions.

Obviously, many modifications and variations of the present invention are possible in light of the above teachings and may be practiced otherwise than as specifically described while within the scope of the appended claims.

What is claimed is:

1. A method for casting metal, comprising:

providing a pair of dies each formed of a first metal material, wherein each of the dies presents a molding surface, the molding surfaces face one another to provide a mold, and wherein at least one heat sink block formed of a second metal material having a thermal conductivity greater than the thermal conductivity of the first metal material is disposed on at least one of the dies and is spaced from the molding surface of the at least one of the dies, and wherein the at least one heat sink block block includes a plurality of cooling channels for conveying cooling fluid, and wherein a contact plate formed of a third metal material is disposed between the at least one heat sink block and the at least one of the dies, wherein a portion of the contact plate is spaced from the at least one of the dies by an air gap;

providing a shot of molten metal to the mold;

allowing the shot of molten metal to solidify and removing the solidified metal prior to providing another shot of molten metal to the mold; and supplying the cooling fluid to the cooling channels for a predetermined amount of time while the shot of molten metal is being provided to the mold or disposed in the mold.

2. The method of claim 1 wherein the first metal material of the dies is a steel material, and the second metal material of the at least one heat sink block is copper or a copper alloy.

3. The method of claim 1 including disposing a contact plate formed of a third metal material between the at least one heat sink block and the dies.

* * * * *